US009330596B2

(12) United States Patent
Choi et al.

(10) Patent No.: US 9,330,596 B2
(45) Date of Patent: May 3, 2016

(54) PIXEL CAPABLE OF DISPLAYING AN IMAGE WITH UNIFORM BRIGHTNESS AND ORGANIC LIGHT EMITTING DISPLAY USING THE SAME

(75) Inventors: Sang-Moo Choi, Yongin (KR); Seong-Il Park, Yongin (KR); Keum-Nam Kim, Yongin (KR); Dong-Beom Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 760 days.

(21) Appl. No.: 13/092,095

(22) Filed: Apr. 21, 2011

(65) Prior Publication Data

US 2012/0105410 A1 May 3, 2012

(30) Foreign Application Priority Data

Oct. 28, 2010 (KR) ..... 10-2010-0105795

(51) Int. Cl.
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01)

(58) Field of Classification Search
CPC ..... G09G 3/3233; G09G 2320/0233; G09G 2300/0819; G09G 2300/0861; G09G 2300/0852
USPC ..... 345/82, 76, 211
See application file for complete search history.

(56) References Cited

U.S. PATENT DOCUMENTS

| | | | | |
|---|---|---|---|---|
| 8,054,259 | B2 * | 11/2011 | Kim | 345/82 |
| 2004/0041525 | A1 | 3/2004 | Park et al. | |
| 2005/0017934 | A1 * | 1/2005 | Chung et al. | 345/82 |
| 2008/0246697 | A1 * | 10/2008 | Kim | 345/76 |
| 2009/0219232 | A1 * | 9/2009 | Choi | 345/76 |
| 2009/0309816 | A1 * | 12/2009 | Choi | 345/76 |
| 2010/0156762 | A1 * | 6/2010 | Choi | 345/76 |
| 2010/0164847 | A1 * | 7/2010 | Lee et al. | 345/77 |

FOREIGN PATENT DOCUMENTS

| | | | |
|---|---|---|---|
| CN | 1479270 | A | 3/2004 |
| CN | 100386794 | C | 5/2008 |
| CN | 101281719 | A | 10/2008 |
| KR | 10-2004-0019207 | A | 3/2004 |

(Continued)

OTHER PUBLICATIONS

Chinese Office action issued in corresponding Application No. 201110234315.9, dated Nov. 18, 2014; 9 pages.

(Continued)

*Primary Examiner* — John Kirkpatrick
(74) *Attorney, Agent, or Firm* — Lewis Roca Rothgerber Christie LLP

(57) ABSTRACT

A pixel capable of displaying an image with uniform brightness. The pixel includes an organic light emitting diode (OLED), a first transistor for controlling an amount of current supplied from a first power source coupled to a first electrode to the OLED, a second transistor coupled between a gate electrode of the first transistor and an initial power source to be turned on when a second scan signal is supplied to a second scan line, a first capacitor coupled between the gate electrode of the first transistor and the first power source, and a second capacitor whose first terminal is coupled to a first electrode of the first transistor.

11 Claims, 4 Drawing Sheets

(56) References Cited

FOREIGN PATENT DOCUMENTS

| | | | |
|---|---|---|---|
| KR | 10-2005-0005646 | A | 1/2005 |
| KR | 10-2006-0135749 | A | 12/2006 |
| KR | 10-2008-0060967 | A | 7/2008 |

OTHER PUBLICATIONS

SIPO Office Action dated May 15, 2015, for corresponding CN Application No. 201110234315.9, with English translation (16 pages).

* cited by examiner

PIXEL CAPABLE OF DISPLAYING AN IMAGE WITH UNIFORM BRIGHTNESS AND ORGANIC LIGHT EMITTING DISPLAY USING THE SAME

CROSS-REFERENCE TO RELATED APPLICATION

This application claims priority to and the benefit of Korean Patent Application No. 10-2010-0105795, filed on Oct. 28, 2010, in the Korean Intellectual Property Office, the entire content of which is incorporated herein by reference.

BACKGROUND

1. Field

The following description relates to a pixel and an organic light emitting display using the same, and more particularly, to a pixel capable of displaying an image with uniform brightness and an organic light emitting display using the same.

2. Description of Related Art

Recently, various flat panel displays (FPD) that are lighter in weight and smaller in volume than comparable cathode ray tubes (CRT) have been developed. The FPDs include a liquid crystal display (LCD), a field emission display (FED), a plasma display panel (PDP), and an organic light emitting display.

Among the FPDs, the organic light emitting display displays an image using organic light emitting diodes (OLED) that generate light by re-combination of electrons and holes. The organic light emitting display has high response speed and is driven with low power consumption.

The organic light emitting display includes a plurality of pixels arranged in a matrix at the crossings (or intersections) of a plurality of data lines, scan lines, and power source lines. The pixels may include organic light emitting diodes (OLED) and driving transistors for driving the amount of current that flows to the OLEDs. The pixels generate light with set or predetermined brightness while supplying current from the driving transistors to the OLEDs to correspond to data signals.

SUMMARY

Accordingly, aspects of embodiments of the present invention are directed toward a pixel capable of displaying an image with uniform brightness and an organic light emitting display using the same.

In order to achieve the foregoing and/or other aspects of the present invention, there is provided in an embodiment of the present invention a pixel, including an organic light emitting diode (OLED), a first transistor for controlling an amount of current supplied from a first power source coupled to a first electrode to the OLED, a second transistor coupled between a gate electrode of the first transistor and an initial power source to be turned on when a second scan signal is supplied to a second scan line, a first capacitor coupled between the gate electrode of the first transistor and the first power source, and a second capacitor whose first terminal is coupled to a first electrode of the first transistor.

In one or more embodiments, the second terminal of the second capacitor is coupled to a fixed voltage source. The first capacitor is set to have a higher capacity than the second capacitor. The pixel further includes a third transistor coupled between the first electrode of the first transistor and a data line and turned on when a first scan signal is supplied to a first scan line, a fourth transistor coupled between the gate electrode of the first transistor and a second electrode of the first transistor and turned on when a first scan signal is supplied to the first scan line, a fifth transistor coupled between the first electrode of the first transistor and the first power source and turned off when an emission control signal is supplied to an emission control line, and a sixth transistor coupled between the second electrode of the first transistor and the OLED and turned off when the emission control signal is supplied to the emission control line. The turn on time of the fifth transistor does not overlap turn on the times of the first transistor and the second transistor. The second terminal of the second capacitor is coupled to the emission control line.

In another embodiment of the present invention, there is provided an organic light emitting display, including a scan driver for supplying first scan signals to first scan lines, for supplying second scan signals to second scan lines, and for supplying emission control signals to emission control lines, a data driver for supplying data signals to data lines in synchronization with the first scan signals, and pixels positioned at crossings of the first scan lines and the data lines. Each of the pixels positioned in an ith (i is a natural number) horizontal line includes an OLED, a first transistor for controlling an amount of current supplied from a first power source coupled to a first electrode to the OLED, a second transistor coupled between a gate electrode of the first transistor and an initial power source and turned on when a second scan signal of the second scan signals is supplied to an ith second scan line of the second scan lines, a first capacitor coupled between the gate electrode of the first transistor and the first power source, and a second capacitor whose first terminal is coupled to a first electrode of the first transistor.

In one or more embodiments, the second terminal of the second capacitor is coupled to a fixed voltage source. The first capacitor is set to have a higher capacity than the second capacitor. The scan driver supplies a first scan signal of the first scan signals to an ith first scan line of the first scan lines after the second scan signal is supplied to the ith second scan line. The scan driver supplies the first scan signal to the ith first scan line after at least a two horizontal period after the second scan signal is supplied to the ith second scan line. The scan driver supplies an emission control signal of the emission control signals to an ith emission control line of the emission control lines to overlap the second scan signal supplied to the ith second scan line and the first scan signal supplied to the ith first scan line. The second terminal of the second capacitor is coupled to the emission control line. The organic light emitting display further includes a third transistor coupled between the first electrode of the first transistor and a data line and turned on when the first scan signal is supplied to the ith first scan line, a fourth transistor coupled between the gate electrode of the first transistor and a second electrode of the first transistor and turned on when the first scan signal is supplied to the ith first scan line, a fifth transistor coupled between the first electrode of the first transistor and the first power source and turned off when the emission control signal is supplied to the ith emission control line, and a sixth transistor coupled between the second electrode of the first transistor and the OLED and turned off when the emission control signal is supplied to the ith emission control line.

In the pixel and the organic light emitting display using the same according to embodiments of the present invention, the on bias voltage is applied to the driving transistors included in the pixels to initialize the characteristics of the driving transistors. When the characteristics of the driving transistors included in the pixels are initialized, an image with uniform brightness may be displayed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EMBODIMENTS

Figure 1:
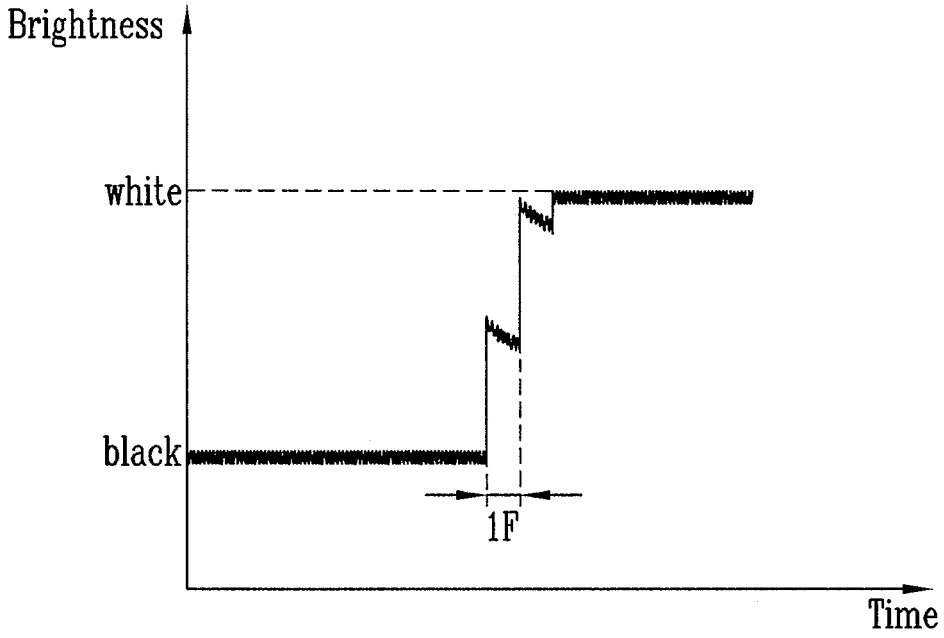
FIG. 1 is a graph illustrating brightness when white gray scales are displayed after black gray scales.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via one or more third elements. Further, some of the elements that are not essential to the complete understanding of the invention are omitted for clarity. Also, like reference numerals refer to like elements throughout.

In a comparable pixel of an organic light emitting display, as illustrated in FIG. 1, when white gray scales are displayed after realizing black gray scales, in about two frame period, light with lower brightness than desired brightness is generated. In this case, an image with desired brightness is not displayed to correspond to the gray scales by the pixels so that uniformity of brightness deteriorates and that picture quality of moving picture deteriorates.

As a result of experiment and inventor insight, in the organic light emitting display, deterioration of a response characteristic is determined to be caused by the characteristics of the driving transistors included in the pixels. That is, the threshold voltages of the driving transistors are shifted to correspond to the voltages applied to the driving transistors in a previous frame period and light with desired brightness is not generated by the current frame due to the shifted threshold voltages.

Embodiments by which those skilled in the art may easily perform the present invention will be described with reference to FIGS. 2 to 5.

Figure 2:
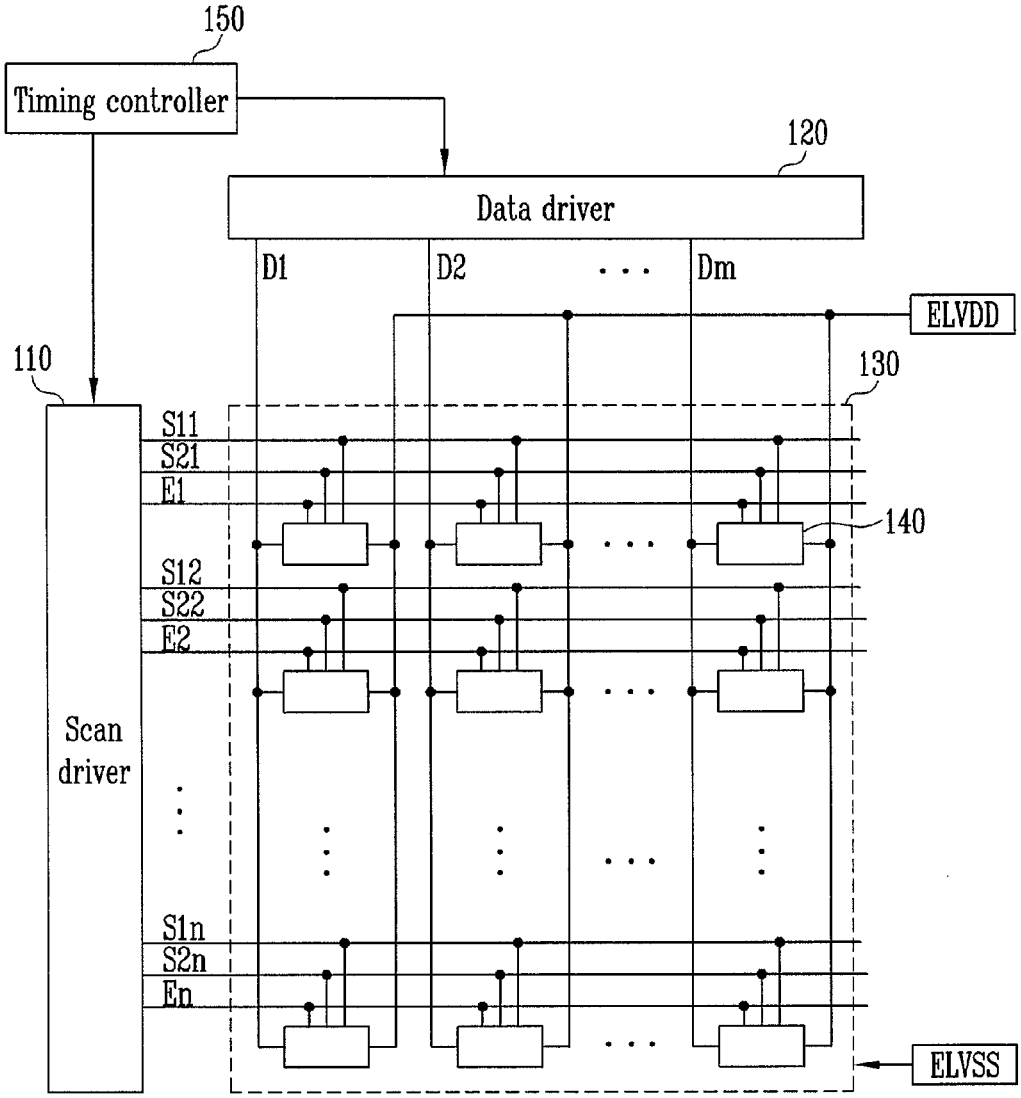
FIG. 2 is a view illustrating an organic light emitting display according to an embodiment of the present invention.

FIG. 2 is a view illustrating an organic light emitting display according to an embodiment of the present invention.

Referring to FIG. 2, the organic light emitting display includes a pixel unit (or display region) 130 including pixels 140 positioned to be coupled to first scan lines S11 to S1*n* and data lines D1 to Dm, a scan driver 110 for driving the first scan lines S11 to S1*n*, second scan lines S21 to S2*n*, and emission control lines E1 to En, a data driver 120 for driving the data lines D1 to Dm, and a timing controller 150 for controlling the scan driver 110 and the data driver 120.

The scan driver 110 receives scan driving control signals SCS from the timing controller 150. The scan driver 110 supplies first scan signals to the first scan lines S11 to S1*n* and supplies second scan signals to the second scan lines S21 to S2*n*. In addition, the scan driver 110 generates emission control signals and sequentially supplies the generated emission control signals to the emission control lines E1 to En.

The first control signal supplied to the ith (i is a natural number) first scan line S1*i* is supplied after the second scan signal is supplied to the ith second scan line S2*i*. The emission control signal supplied to the ith emission control line Ei overlaps the first scan signal supplied to the ith first scan line S1*i* and the ith second scan line S2*i*.

The data driver 120 receives data driving control signals DCS from the timing controller 150. The data driver 120 that receives the data driving control signals DCS supplies data signals to the data lines D1 to Dm in synchronization with the first scan signals.

The timing controller 150 generates the data driving control signals DCS and the scan driving control signals SCS to correspond to (or to match) the synchronizing signals supplied from the outside. The data driving control signals DCS generated by the timing controller 150 are supplied to the data driver 120, and the scan driving control signals SCS are supplied to the scan driver 110. Then, the timing controller 150 supplies the data supplied from the outside to the data driver 120.

The pixel unit 130 receives a first power of a first power source ELVDD and a second power of a second power source ELVSS from the outside to supply the first power of the first power source ELVDD and the second power of the second power source ELVSS to the pixels 140. The pixels 140 that receive the first power of the first power source ELVDD and the second power of the second power source ELVSS generate light with set or predetermined brightness while controlling the amount of current that flows from the first power source ELVDD to the second power source ELVSS via the OLED to correspond to the data signals.

Figure 3:
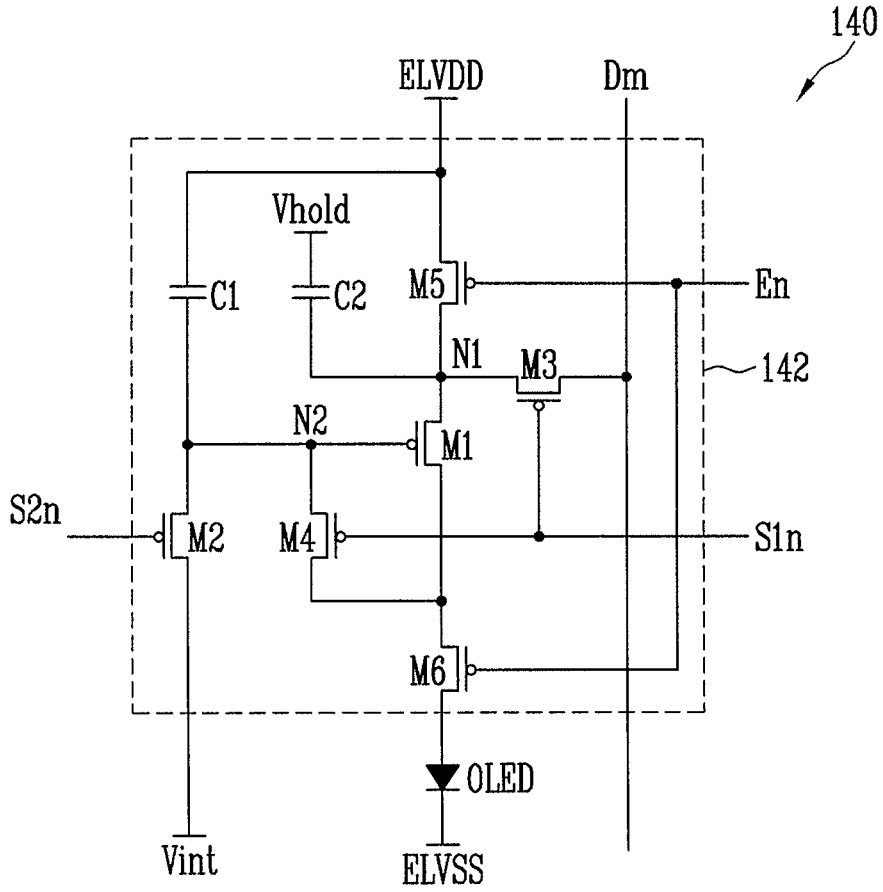
FIG. 3 is a view illustrating an embodiment of the pixel of FIG. 2.

FIG. 3 is a view illustrating an embodiment of the pixel 140 of FIG. 2.

Referring to FIG. 3, the pixel 140 according to this embodiment of the present invention includes a pixel circuit 142 coupled to the OLED, the data line Dm, the first scan line S1*n*, the second scan line S2*n*, and the emission control line En to control the amount of current supplied to the OLED.

The anode electrode of the OLED is coupled to the pixel circuit 142 and the cathode electrode is coupled to the second power source ELVSS. The OLED generates light with set or predetermined brightness to correspond to the amount of current supplied from the first power source ELVDD via the pixel circuit 142.

The pixel circuit 142 controls the amount of current supplied to the OLED to correspond to a data signal. Therefore, the pixel circuit 142 includes first to sixth transistors M1 to M6, a first capacitor C1, and a second capacitor C2.

The first electrode of the first transistor (or driving transistor) M1 is coupled to a first node N1, and the second electrode of the first transistor M1 is coupled to the first electrode of the sixth transistor M6. Then, the gate electrode of the first transistor M1 is coupled to a second node N2. The first transistor M1 controls the amount of current supplied to the OLED to correspond to (or to match) the voltage charged in the first capacitor C1.

The first electrode of the second transistor M2 is coupled to the second node N2, and the second electrode of the second transistor M2 is coupled to the initial power source Vint. Then, the gate electrode of the second transistor M2 is coupled to the second scan line S2*n*. The second transistor M2 is turned on when the second scan signal is supplied to the second scan line S2*n* to supply the voltage of the initial power source Vint to the second node N2. Here, the initial power source Vint is set to have a lower voltage than the data signals.

The first electrode of the third transistor M3 is coupled to the data line Dm, and the second electrode of the third transistor M3 is coupled to the first node N1. Then, the gate electrode of the third transistor M3 is coupled to the first scan line S1*n*. The third transistor M3 is turned on when the first scan signal is supplied to the first scan line S1*n* to electrically couple the data line Dm to the first node N1.

The first electrode of the fourth transistor M4 is coupled to the second electrode of the first transistor M1, and the second electrode of the fourth transistor M4 is coupled to the second node N2. Then, the gate electrode of the fourth transistor is coupled to the first scan line S1*n*. The fourth transistor M4 is turned on when the first scan signal is supplied to the first scan line S1*n* to couple the first transistor M1 in the form of a diode.

The first electrode of the fifth transistor M5 is coupled to the first power source ELVDD, and the second electrode of the fifth transistor M5 is coupled to the first node N1. Then, the gate electrode of the fifth transistor M5 is coupled to the emission control line En. The fifth transistor M5 is turned off when the emission control signal is supplied to the emission control line En and is turned on when the emission control signal is not supplied.

The first electrode of the sixth transistor M6 is coupled to the second electrode of the first transistor M1, and the second electrode of the sixth transistor M6 is coupled to the anode electrode of the OLED. Then, the gate electrode of the sixth transistor M6 is coupled to the emission control line En. The sixth transistor M6 is turned off when the emission control signal is supplied to the emission control line En and is turned on when the emission control signal is not supplied.

The first capacitor C1 is coupled between the second node N2 and the first power source ELVDD. The first capacitor C1 stores (or is charged with) the voltage corresponding to (or matching) the data signal.

The second capacitor C2 is coupled between the first node N1 and a fixed power source Vhold. The second capacitor C2 stores (or is charged with) the voltage of (or corresponding to) the first power source ELVDD. The fixed power source Vhold as a fixed voltage may be set as various suitable voltage values.

On the other hand, the second capacitor C2 for storing the voltage of the first power source ELVDD applied to the first node N1 is set to have a lower capacity (or capacitance) than the first capacitor C1 considering an aperture ratio. In addition, the second capacitor C2 is set to have a higher capacity (or capacitance) than the parasitic capacitors (or parasitic capacitances) of the transistors M1, M3, and M5 coupled to the first node N1 so that the voltage of the first power source ELVDD may be stably charged.

In addition, according to the present invention, the structure of the pixel circuit 142 is not limited to the structure illustrated in FIG. 3. For example, the pixel circuit 142 according to an embodiment of the present invention may have various suitable structural types that include the first transistor M1, the second transistor M2, and the second capacitor C2.

Figure 4:
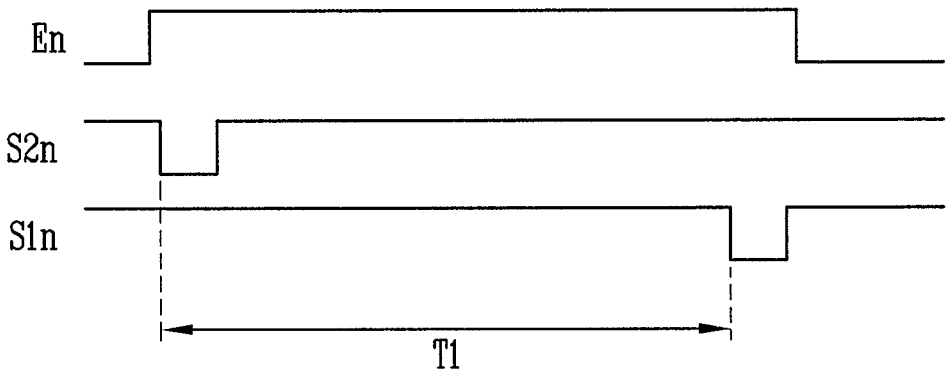
FIG. 4 is a waveform chart illustrating a method of driving the pixel of FIG. 3.

FIG. 4 is a waveform chart illustrating a method of driving the pixels of FIG. 3.

Referring to FIG. 4, in a period where the emission control signal is not supplied to the emission control line En, the fifth transistor M5 and the sixth transistor M6 are set to be in a turn on state. At this time, the first transistor M1 controls the amount of current that flows from the first power source ELVDD to the second power source ELVSS via the OLED to correspond to the voltage stored in the first capacitor C1. On the other hand, in a period where the fifth transistor M5 is set to be in the turn on state, the second capacitor C2 stores the voltage corresponding to the first power source ELVDD.

Then, the emission control signal is supplied to the emission control line En, and the second scan signal is supplied to the second scan line S2*n*. When the emission control signal is supplied to the emission control line En, the fifth transistor M5 and the sixth transistor M6 are turned off.

When the fifth transistor M5 is turned off, electric coupling between the first node N1 and the first power source ELVDD is blocked. At this time, the first node N1 maintains the voltage of the first power source ELVDD to correspond to the voltage stored in the second capacitor C2. When the sixth transistor M6 is turned off, electric coupling between the first transistor M1 and the OLED is blocked.

When the second scan signal is supplied to the second scan line S2*n*, the second transistor M2 is turned on. When the second transistor M2 is turned on, the voltage of the initial power source Vint is supplied to the second node N2 so that the second node N2 is initialized to the voltage of the initial power source Vint. At this time, the first capacitor C1 charges the voltage corresponding to the voltage of the initial power source Vint.

In this case, in a first period T1, the second node N2 is set to have the voltage of the initial power source Vint, and the first node N1 is set to have the voltage of the first power source ELVDD. Then, in the first period T1, an on bias voltage is supplied to the first transistor M1 so that the characteristic of the first transistor M1 is initialized to an on bias state.

Then, the first scan signal is supplied to the first scan line S1*n* so that the third transistor M3 and the fourth transistor M4 are turned on. When the fourth transistor M4 is turned on, the first transistor M1 is coupled in the form of a diode. When the third transistor M3 is turned on, the data signal from the data line Dm is supplied to the first node N1.

At this time, since the second node N2 is set to have the voltage of the initial power source Vint, the first transistor M1 is turned on. When the first transistor M1 is turned on, the voltage obtained by subtracting the threshold voltage of the first transistor M1 from the data signal is applied to the second node N2. Then, the first capacitor C1 is charged with a set or predetermined voltage to correspond to the voltage applied to the second node N2.

After the set or predetermined voltage is charged (or stored) in the first capacitor C1, the supply of the emission control signal to the emission control line En is stopped so that the fifth transistor M5 and the sixth transistor M6 are turned on. When the fifth transistor M5 and the sixth transistor M6 are turned on, a current path is formed from the first power source ELVDD to the second power source ELVSS via the OLED. At this time, the first transistor M1 controls the amount of current supplied to the OLED to correspond to the voltage charged in the first capacitor C1.

As described above, according to the present invention, the on bias voltage is applied to the first transistor M1 before the voltage corresponding to the data signal is charged (or stored) in the first capacitor C1. When the on bias voltage is applied to the first transistor M1, the characteristic curve (or the threshold voltage) of the first transistor M1 is initialized to be in a uniform state. That is, the first transistor M1 included in each of the pixels 140 is initialized to a state of displaying a white gray scale. In this case, when the white gray scale is realized by the next frame, light with the same brightness is generated by all of the pixels 140 so that an image with uniform brightness may be displayed.

On the other hand, according to an embodiment of the present invention, the first period T1 is set no less than a two horizontal period 2H. Here, in one example, when the on bias voltage is applied to the first transistor M1 in a period less than 2H, all of the characteristics of the first transistors M1 included in the pixels 140 are not initialized to a uniform state. Therefore, according to an embodiment of the present invention, the first period T1 is set to be no less than 2H so that all of the characteristics of the first transistors M1 are initialized to be in a uniform state. Then, the upper limit of the first period T1 is determined by experiments. That is, the upper limit of the first period T1 is determined by the experiments considering the inch and resolution of a panel. For example, in a specific panel, the first period T1 may be set as a period between no less than 2H and no more than half of one frame.

On the other hand, in FIG. 3, the second capacitor C2 is coupled to the fixed power source Vhold. However, the present invention is not limited to the above. For example, the second capacitor C2 may be coupled to one of the signal lines coupled to the pixel circuit 142.

Figure 5:
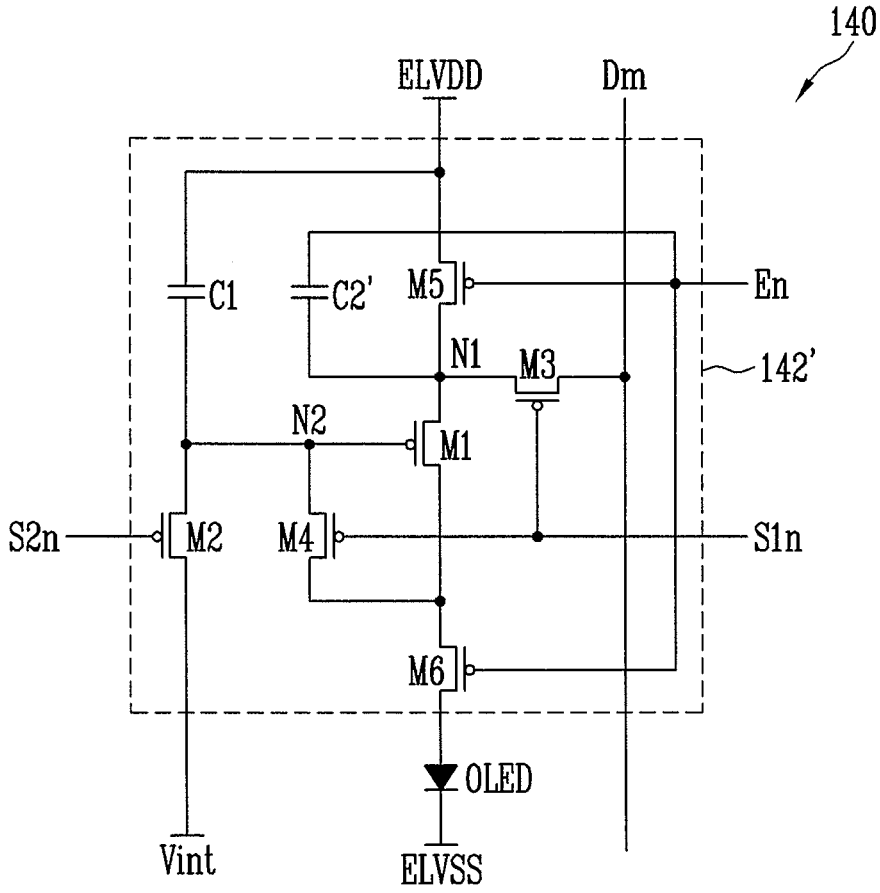
FIG. 5 is a view illustrating another embodiment of the pixel of FIG. 2.

FIG. 5 is a view illustrating another embodiment of the pixel of FIG. 2. In FIG. 5, the same elements as those of FIG. 3 are denoted by the same reference numerals and detailed description thereof will be omitted.

Referring to FIG. 5, the pixel 140 according to the embodiment of the present invention includes a pixel circuit 142' coupled to the OLED, the data line Dm, the first scan line S1*n*, the second scan line S2*n*, and the emission control line En to control the amount of current supplied to the OLED.

The second capacitor C2' included in the pixel circuit 142' is coupled between the emission control line En and the first node N1. The second capacitor C2' stores the voltage corresponding to the first power source ELVDD.

When operation processes are schematically described with reference to FIGS. 4 and 5, in a period where the emission control signal is not supplied to the emission control line En, the fifth transistor M5 and the sixth transistor M6 are set to be in the turn on state. At this time, the first transistor M1 controls the amount of current that flows from the first power source ELVDD to the second power source ELVSS via the OLED to correspond to the voltage charged in the first capacitor C1. On the other hand, in a period where the fifth transistor M5 is set to be in the turn on state, the second capacitor C2' stores the voltage corresponding to the first power source ELVDD.

Then, the emission control signal is supplied to the emission control line En so that the fifth transistor M5 and the sixth transistor M6 are turned off, and the second scan signal is supplied to the second scan line S2*n* so that the second transistor M2 is turned on.

When the second transistor M2 is turned on, the voltage of the initial power source Vint is supplied to the second node N2. When the fifth transistor M5 is turned off, electric coupling between the first power source ELVDD and the first node N1 is blocked. When the emission control signal is supplied to the emission control line En, the voltage of the first node N1 increases to a higher voltage than the first power source ELVDD by the coupling of the second capacitor C2'.

When the second node N2 is set to have the initial power source Vint and the first node N1 is set to have a higher voltage than the first power source ELVDD, the on bias voltage is supplied to the first transistor M1. Here, the first transistor M1 receives the on bias voltage in the first period T1 so that the characteristic of the first transistor M1 is initialized.

On the other hand, since the first node N1 is set to have a higher voltage than the first power source ELVDD in the first period T1, the high on bias voltage may be applied so that the first period T1 may be reduced in comparison with the pixel of FIG. 3.

Then, the first scan signal is supplied to the first scan line S1*n* so that the third transistor M3 and the fourth transistor M4 are turned on. When the third transistor M3 and the fourth transistor M4 are turned on, the data signal from the data line Dm is supplied to the first node N1, and the first capacitor C1 stores the voltage corresponding to the first capacitor C1.

After a set or predetermined voltage is charged in the first capacitor C1, the supply of the emission control signal to the emission control line En is stopped so that the fifth transistor M5 and the sixth transistor M6 are turned on. When the fifth transistor M5 and the sixth transistor M6 are turned on, a current path is formed from the first power source ELVDD to the second power source ELVSS via the OLED. At this time, the first transistor M1 controls the amount of current supplied to the OLED to correspond to the voltage charged in the first capacitor C1.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED);

a first transistor for controlling an amount of current supplied from a first power source, the first transistor coupled between a first electrode of the OLED and the first power source;

a second transistor coupled between a gate electrode of the first transistor and an initial power source and configured to be turned on when a second scan signal is supplied to a second scan line;

a first capacitor coupled between the gate electrode of the first transistor and the first power source; and a second capacitor whose first terminal is directly coupled to a first electrode of the first transistor at a node that is between the first transistor and the first power source, wherein a second electrode of the OLED is directly coupled to a second power source, wherein a second terminal of the second capacitor is directly coupled to a fixed voltage source different from the first power source, the initial power source, and the second power source, and wherein the first capacitor is set to have a higher capacity than the second capacitor.

2. The pixel as claimed in claim 1, further comprising:

a third transistor coupled between the first electrode of the first transistor and a data line and configured to be turned on when a first scan signal is supplied to a first scan line;

a fourth transistor coupled between the gate electrode of the first transistor and a second electrode of the first transistor and configured to be turned on when the first scan signal is supplied to the first scan line;

a fifth transistor coupled between the first electrode of the first transistor and the first power source and configured to be turned off when an emission control signal is supplied to an emission control line; and a sixth transistor coupled between the second electrode of the first transistor and the OLED and configured to be turned off when the emission control signal is supplied to the emission control line.

3. The pixel as claimed in claim 2, wherein turn on time of the fifth transistor is configured to not overlap turn on times of the first transistor and the second transistor.

4. The pixel as claimed in claim 1, further comprising:

a third transistor coupled between the first electrode of the first transistor and a data line and configured to be turned on when a first scan signal is supplied to a first scan line, wherein during a first period after the second scan signal is supplied to the second scan line but before a first scan signal is supplied to the first scan line, an on bias voltage is supplied to the first transistor, and wherein the second scan signal and the first scan signal are separated from each other by a period of time.

5. An organic light emitting display, comprising:

a scan driver for supplying first scan signals to first scan lines, for supplying second scan signals to second scan lines, and for supplying emission control signals to emission control lines;

a data driver for supplying data signals to data lines in synchronization with the first scan signals; and pixels positioned at crossings of the first scan lines and the data lines, wherein each of the pixels positioned in an ith (i is a natural number) horizontal line comprises:

an OLED;

a first transistor for controlling an amount of current supplied from a first power source, the first transistor coupled between a first electrode of the OLED and the first power source;

a second transistor coupled between a gate electrode of the first transistor and an initial power source and configured to be turned on when a second scan signal of the second scan signals is supplied to an ith second scan line of the second scan lines;

a first capacitor coupled between the gate electrode of the first transistor and the first power source; and a second capacitor whose first terminal is directly coupled to a first electrode of the first transistor at a node that is between the first transistor and the first power source, wherein a second electrode of the OLED is directly coupled to a second power source, wherein a second terminal of the second capacitor is directly coupled to a fixed voltage source different from the first power source, the initial power source, and the second power source and wherein the first capacitor is set to have a higher capacity than the second capacitor.

6. The organic light emitting display as claimed in claim 5, wherein the scan driver is configured to supply a first scan signal of the first scan signals to an ith first scan line of the first scan lines after the second scan signal is supplied to the ith second scan line.

7. The organic light emitting display as claimed in claim 6, wherein the scan driver is configured to supply the first scan signal to the ith first scan line after at least two horizontal periods after the second scan signal is supplied to the ith second scan line.

8. The organic light emitting display as claimed in claim 6, wherein the scan driver is configured to supply an emission control signal of the emission control signals to an ith emission control line of the emission control lines to overlap the second scan signal supplied to the ith second scan line and the first scan signal supplied to the ith first scan line.

9. The organic light emitting display as claimed in claim 8, further comprising:

a third transistor coupled between the first electrode of the first transistor and a data line of the data lines and configured to be turned on when the first scan signal is supplied to the ith first scan line;

a fourth transistor coupled between the gate electrode of the first transistor and a second electrode of the first transistor and configured to be turned on when the first scan signal is supplied to the ith first scan line;

a fifth transistor coupled between the first electrode of the first transistor and the first power source and configured to be turned off when the emission control signal is supplied to the ith emission control line; and a sixth transistor coupled between the second electrode of the first transistor and the OLED and configured to be turned off when the emission control signal is supplied to the ith emission control line.

10. The organic light emitting display as claimed in claim 5, wherein the scan driver is configured to supply the first scan signal to an ith first scan line, and wherein during a first period, an on bias voltage is supplied to the first transistor after the second scan signal is supplied to the ith second scan line but before the first scan signal is supplied to the ith first scan line, and wherein the second scan signal and the first scan signal are separated from each other by a period in time.

11. The organic light emitting display as claimed in claim 10, wherein the first period is set long enough to initialize all of the first transistors in the pixels to a uniform state.

* * * * *